US012128283B1

(12) United States Patent
Lentner

(10) Patent No.: US 12,128,283 B1
(45) Date of Patent: Oct. 29, 2024

(54) NESTING CORN HOLE BOARDS

(71) Applicant: Joshua M. Lentner, Savage, MN (US)

(72) Inventor: Joshua M. Lentner, Savage, MN (US)

( * ) Notice: Subject to any disclaimer, the term of this patent is extended or adjusted under 35 U.S.C. 154(b) by 350 days.

(21) Appl. No.: 17/308,044

(22) Filed: May 4, 2021

(51) Int. Cl.
*A63B 67/06* (2006.01)

(52) U.S. Cl.
CPC ..... *A63B 67/06* (2013.01); *A63B 2210/50* (2013.01)

(58) Field of Classification Search
CPC ..... A63B 67/06; A63B 2210/50; A63B 2067/061; A63B 2200/0037; A63B 2200/0035; A47B 2023/005; A47B 3/00
USPC ..... 273/398–402
See application file for complete search history.

(56) References Cited

U.S. PATENT DOCUMENTS

| | | | | |
|---|---|---|---|---|
| 285,396 | A | 9/1883 | De Windt | |
| 2,050,846 | A * | 8/1936 | Johannsen | D06F 81/02 108/123 |
| 2,050,914 | A | 8/1936 | Anderson | |
| 3,628,793 | A | 12/1971 | Mudloff | |
| D246,059 | S | 10/1977 | Malish | |
| 4,709,929 | A | 12/1987 | Mills et al. | |
| 4,936,590 | A | 6/1990 | Palmer | |
| 4,943,065 | A | 7/1990 | Delapa | |
| 4,961,586 | A * | 10/1990 | Conville | A63F 9/02 273/402 |
| 4,986,549 | A | 1/1991 | Kuhtic et al. | |
| 5,056,796 | A | 10/1991 | Conville | |
| 5,056,797 | A | 10/1991 | Hockert et al. | |
| 5,165,695 | A | 11/1992 | Yoder | |
| 5,201,527 | A | 4/1993 | Koket | |
| D340,082 | S | 10/1993 | Delapa | |
| D375,125 | S | 10/1996 | Mallek et al. | |
| D375,530 | S | 11/1996 | Rudd | |
| 5,871,216 | A | 2/1999 | Sparacino | |
| 5,909,877 | A | 6/1999 | Bour | |
| 6,244,598 | B1 | 6/2001 | Conville | |
| D489,415 | S | 5/2004 | Grunt | |
| 6,749,201 | B2 | 6/2004 | Kessler, Jr. et al. | |
| 6,932,345 | B1 | 8/2005 | O'Dell | |
| D544,041 | S | 6/2007 | Murphy et al. | |

(Continued)

OTHER PUBLICATIONS

Nesting Cornhole; Nesting Cornhole 3D Model and Drawing with Dimensions by The Chad Experience published Aug. 18, 2017 at https://chadmunkres.blogspot.com/2017/08/nesting-cornhole-3d-model-and-drawing.html (Year: 2017).*

(Continued)

*Primary Examiner* — Michael D Dennis
(74) *Attorney, Agent, or Firm* — Albert W. Watkins

(57) ABSTRACT

A nested corn hole board game includes a pair of corn hole target boards that nest together. Each corn hole target board has a playing surface that has a "U" shaped frame member on a bottom major face. The inner frame member is fully enclosed by an inner leg set spanning the ends of the "U" legs. There is a gap between the outer "U" shaped frame member and the outer leg set sized to allow the inner "U" shaped frame members to slipping between the outer "U" shaped frame members and the outer leg set. When arranged in this manner, the front frame members of both corn hole target boards are located next to their respective edges of the playing surface, and the distally located leg sets are offset from the distal edge by an identical amount on each playing surface.

14 Claims, 3 Drawing Sheets

(56) References Cited

U.S. PATENT DOCUMENTS

| | | | | |
|---|---|---|---|---|
| 7,237,777 | B2 | 7/2007 | Digges, III et al. | |
| 7,607,666 | B1 | 10/2009 | Studier | |
| 8,127,689 | B2 | 3/2012 | Christian et al. | |
| 8,127,689 | B2 * | 3/2012 | Christian | A63B 67/002 108/11 |
| 8,157,265 | B2 | 4/2012 | Conville et al. | |
| 8,162,318 | B1 | 4/2012 | Peterson et al. | |
| 9,381,414 | B1 | 7/2016 | Gatton et al. | |
| 10,898,775 | B2 * | 1/2021 | Poetter | A63B 67/06 |
| 2007/0080499 | A1 * | 4/2007 | Greiwe | A63B 67/06 273/400 |
| 2008/0116644 | A1 | 5/2008 | Knoernschild | |
| 2008/0157476 | A1 | 7/2008 | Striebel et al. | |
| 2008/0237990 | A1 | 10/2008 | Litz | |
| 2010/0176554 | A1 | 7/2010 | Godwin | |
| 2013/0082442 | A1 * | 4/2013 | Hanel | A63B 67/06 273/398 |
| 2017/0113112 | A1 * | 4/2017 | Voss | A63B 67/06 |

OTHER PUBLICATIONS

"How to Make Nesting Cornhole Boards", 14 pgs, downloaded Apr. 12, 2021, https://www.instructables.com/How-to-Make-Nesting-Cornhole-Boards/.

* cited by examiner

FIG. 6
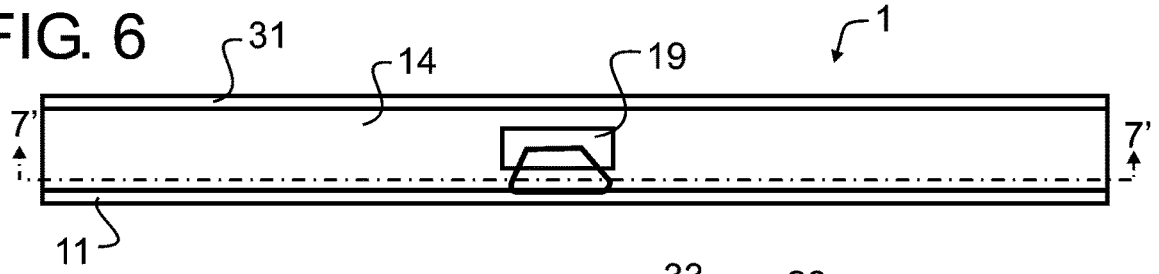
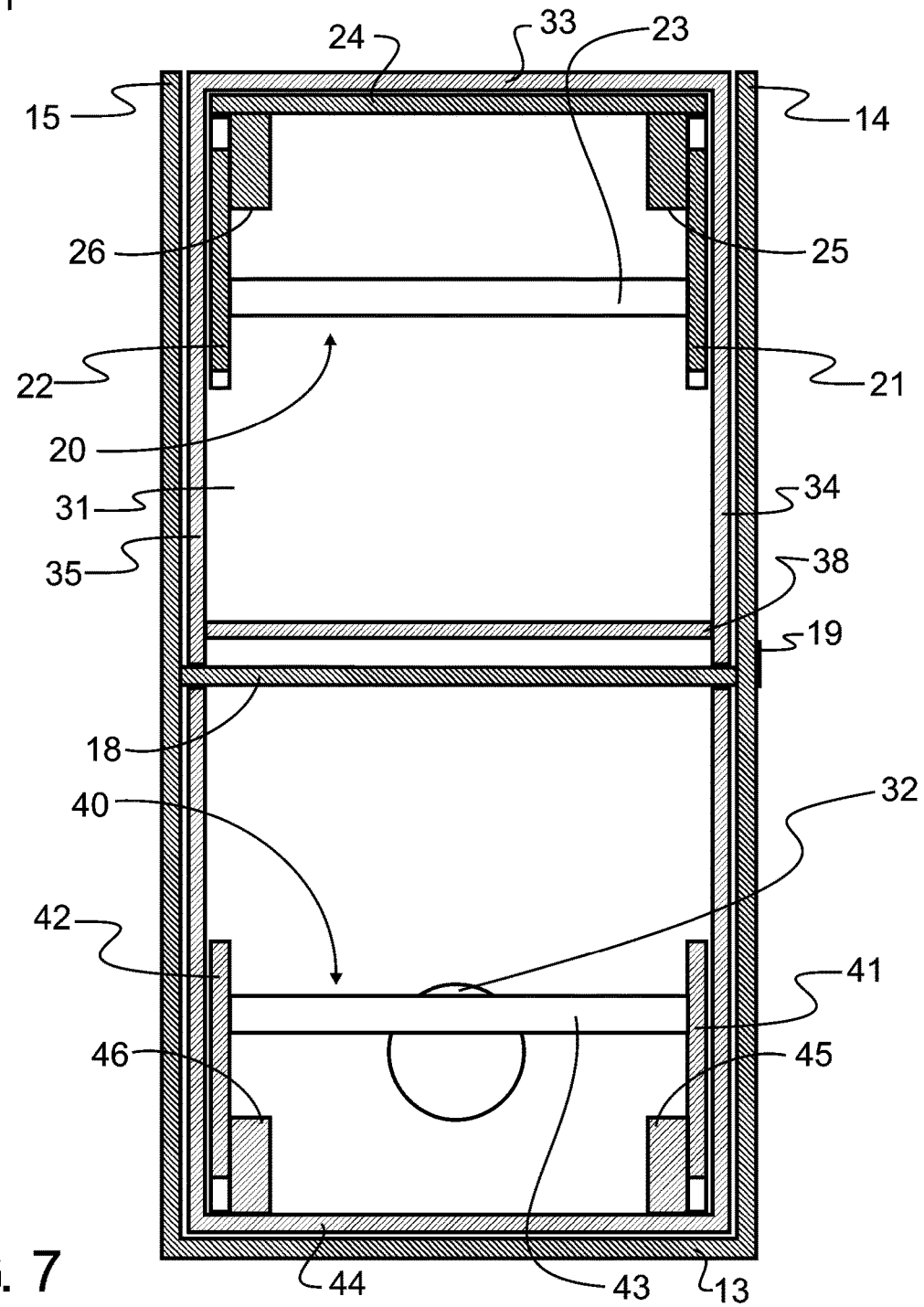
FIG. 7

NESTING CORN HOLE BOARDS

BACKGROUND OF THE INVENTION

1. Field of the Invention

The present invention pertains generally to games and amusement devices, and more particularly to portable games combining hand-tossed aerial projectiles such as weighted bags and apertured, gently inclined targets. One particularly well-known implementation is commonly referred to as "corn hole."

2. Description of the Related Art

While there are many, many games and amusement devices, few provide entertainment that facilitates nearly universal participation. One type of game that does is hand tossing projectiles at least in part through the air toward a target. The movement required for an underhand toss is natural and readily performed by nearly all persons.

As may be appreciated, there have been many hand tossing games devised over centuries, including such games as horse shoes, lawn darts, rings, ball tossing, and bag tossing. While bowling uses a similar motion and is widely enjoyed, the game requires access to a very expensive bowling alley and significant strength to control a heavy ball, and so is not as universal for participation, nor is it portable or available for play wherever desired. Horse shoes and lawn darts are also undesirably limited. An errant throw of a heavy and hard metal horse shoe or sharply pointed lawn dart can have serious adverse consequence. Rings of adequate size for achieving reasonable toss distances suffer from the limitation of heavy and hard horseshoes, while smaller and lighter rings can only be used for very short distances and frustrate participants when affected greatly by the vagaries of the wind. Balls bounce and roll away from the target, and frustrate participants when the balls must be retrieved at the expense of time and enjoyment. In contrast, nominally weighted bags can be tossed by nearly all persons, stay very close to their landing position, are extremely safe, are only very minimally affected by gusts of wind, and are able to be transported for use at many diverse locations. As a result, bag tossing games are particularly well suited for enjoyable, safe and casual entertainment.

One particularly well-enjoyed bag tossing game, commonly referred to as "corn hole," has legend that sometimes attributes the game to a fourteenth-century cabinet maker named Matthias Kuepermann, who it is alleged created the game after watching children toss rocks into a nearby groundhog's hole. More certain recorded history provides an 1883 US patent grant 285,396 by Heyliger A. de Windt, entitled "Game apparatus for playing parlor quoits", the teachings which are incorporated herein by reference. This patent describes an indoor game that is "inexpensive, simple, durable, and noiseless." Illustrated is a gently inclined board with collapsible leg, and fabric bags "scantily filled with beans, rice, or like material".

Modern cornhole combines bags nominally weighted with one pound of plastic beads, dried sand, corn, beans, or rice, and a pair of spaced-apart, gently inclined and apertured targets. A player standing next to one target will toss bags toward the distant target, with a goal of tossing the bag through the aperture, or at least landing the bag on the target surface. The gentle incline provides additional challenge, allowing bags to slide across the surface and through the aperture, or sometimes to slide off of the target surface and onto the surrounding ground. In the event of an errant throw, the bags are both large enough, sufficiently pliable, and light enough to not cause any physical harm. The game can easily be played with more than two people, often in teams. Since players will alternate, there is plenty of opportunity for relaxed socializing and pleasant banter. The spacing between targets is readily adjusted to match the skill level and capability of the participants, and fun is nearly universally had by all. An exemplary and somewhat more modern target is illustrated in US patent Des 246,059 by Malish, entitled "Game target", the teachings and content which are incorporated herein by reference.

Reflecting the wide acceptance and participation of the game, standards organizations known as the American Cornhole Organization (ACO) and American Cornhole League (ACL) have set standards that define the dimensions and surface material of the targets including slope and height above the ground, the weight and dimensions of the bags, and the like. One company, Baggo, founded by a highly skilled artisan in the field, David Conville, has even created a separate set of standards. Leagues have been formed, tournaments established, world champions crowned, and television viewership has on occasion exceeded competing major league baseball games.

While in nearly every way a great advance over the aforementioned other tossing games, there remain a few disadvantages to cornhole. The targets in use are approximately thirty feet apart. In addition, the targets are relatively large to facilitate easy and nearly universal participation. To withstand the impact of one pound bags that can be tossed relatively high into the air and from distance, the targets must be manufactured from sturdy material. However, this large size and necessary sturdiness also means the targets tend to be clumsy to carry and difficult to transport.

Recognizing this limitation, many artisans have proposed various ways to stack a pair of targets. In the case of the aforementioned Baggo and Mr. Conville, the boards are fabricated from molded plastic. Special features in the molded plastic provide coupling. Exemplary U.S. patents, the teachings which are incorporated herein by reference, include: U.S. Pat. No. 4,961,586 by Conville, entitled "Bag tossing game" that describes tabs to nest boards; U.S. Pat. No. 5,056,796 by Conville, entitled "Self contained bag tossing game" that describes snap together boards having snaps, pins, orifices, and guides; and U.S. Pat. No. 8,157,265 by Conville et al, entitled "Bag tossing game with accessory stabilization" that describes foldable plastic molded and interconnecting boards, latches, and a carrying handle.

The Baggo boards offer many excellent features, but require substantial tooling and associated cost, while suffering from inherent limitations of plastic. Baggo has opted for lighter and easier to transport target surfaces of smaller dimensions, but these targets are non-compliant with other standards organizations. As aforementioned, this has led Baggo to develop an independent set of standards. Nevertheless, it is desirable to design a corn hole target board that is compliant with the ACO and ACL standards.

Many other highly skilled artisans have likewise developed more portable cornhole and other tossing game targets. Exemplary U.S. patents, published applications, and published article, the teachings which are incorporated herein by reference, include: U.S. Pat. No. 3,628,793 by Mudloff, entitled "Sandbag and target apparatus in which the target also serves as a carrying case"; U.S. Pat. No. 4,709,929 by Mills et al, entitled "Game board"; U.S. Pat. No. 5,201,527 by Koket, entitled "Tossing game targets and method"; 2007/0080499 by Greiwe et al, entitled "Bag tossing game";

2008/0116644 by Knoernschild, entitled "Toss game"; 2008/0157476 by Striebel et al, entitled "Portable bag tossing game; 2013/0082442 by Hanel, entitled "Bean bag toss game board set"; and the article "How to make Nesting Cornhole Boards" by psingle1 posted to instructables.com on Dec. 17, 2015.

The Mudloff and Mills game boards do not nest, and so require excess and undesirable storage and transport volume. In addition, the Mills game board requires relatively smaller male-female couplers that require the expense of mold tooling and can be hard to align and prone to premature failure.

The Koket patent, while very compact and portable, suffers from defects similar to Conville/Baggo, requiring significant tooling expense while being non-compliant with the ACO and ACL standards.

The Greiwe et al published patent application also requires significant tooling expense, and also does not nest, so again requires excess and undesirable storage and transport volume While the hook and loop fasteners that couple the Striebel game boards together are effective for a new molded board, they will quickly capture lint, plant matter, and other debris when the game boards are deployed, and can also interfere with or undesirably engage with fabric bags. In addition, and like the Mudloff patent, the Striebel game boards do not nest, and so require substantial storage and transport volume.

The Knoernschild and Hanel published patent applications nest one target casing or frame member, respectively, within the other target casing or frame member, which essentially cuts the storage and transport volume almost in half. Unfortunately, the Knoernschild and Hanel nesting designs mean that, when the targets are deployed for play and therefore inclined, the interiorly nestable target has a leading edge that is inset and so significantly lower than the non-inset leading edge of the exteriorly or circumscribing nestable target. This makes the targets non-compliant with the ACO and ACL standards and unsuitable for competitions, and will also invite unpleasant disputes that seriously detract from the otherwise potentially great enjoyment of an appropriately designed cornhole board.

The article "How to make Nesting Cornhole Boards" by psingle1 both recognizes and addresses the deficiency of Knoernschild and Hanel type nesting in step 6, by fabricating an end spacer board that is affixed using carriage bolts and wing nuts when deployed and removed when configured for transport or storage. While clearly improving upon the Knoernschild and Hanel type nesting by addressing rules compliance, this extra board serves both as an undesirable extra impediment during setup and takedown, and also presents undesirable opportunity for the frustrating loss of critical and small parts such as the wing nuts and carriage bolts.

Other exemplary U.S. patents that illustrate various portable tossing games, the teachings which are incorporated herein by reference, include: U.S. Pat. No. 2,050,914 by Anderson, entitled "Game board"; U.S. Pat. No. 4,943,065 by DeLapa, entitled "Bean bag toss game targets"; U.S. Pat. No. 4,986,549 by Kuhtic et al, entitled "Toss game with target compartment areas"; U.S. Pat. No. 5,056,797 by Hockert et al, entitled "Disk toss game"; U.S. Pat. No. 5,165,695 by Yoder, entitled "Bag tossing game"; U.S. Pat. No. 5,871,216 by Sparacino, entitled "Bean bag toss game"; U.S. Pat. No. 5,909,877 by Bour, entitled "Bean bag toss game target"; U.S. Pat. No. 6,244,598 by Conville, entitled "Folding corrugated bag tossing game"; U.S. Pat. No. 6,932,345 by O'Dell, entitled "Portable bean bag toss game assembly"; U.S. Pat. No. 7,237,777 by Digges et al, entitled "Bag toss game target assemblies"; U.S. Pat. No. 7,607,666 by Studier, entitled "Corn toss game"; U.S. Pat. No. 8,127,689 by Christian et al, entitled "Play-ble multifunctional recreational system"; U.S. Pat. No. 9,381,414 by Gatton et al, entitled "Apparatus, system and methods for improved bag toss"; Des 340,082 by DeLapa, entitled "Beanbag tossing game target"; Des 375,125 by Mallek et al, entitled "Bean bag game target"; Des 375,530 by Rudd, entitled "Bean bag game"; and Des 544,041 by Murphy et al, entitled "Bag toss game target assembly".

As may be apparent from the many aforementioned patents and publications, in spite of the enormous advancements and substantial research and development that has been conducted, there still remains a much recognized need in the field for improvements in the stacking and transport of target boards. One of the challenges with stacking the targets is the requirement that the front edge of both targets be at the same height above the ground, and likewise both targets must have like dimension and like inclination. In addition, the components coupling the boards together must be as durable as the required by the large and somewhat heavy boards. Many of the prior art couplers use various pins and sockets or other male-female couplings that are relatively small, hard to align, and fragile. Owing to the large size of the boards, there remains great demand to adequately interlock the targets in a manner that minimizes storage volume, using apparatus which is simultaneously durable, secure and simple and intuitive to use.

Additional patents of varying relevance, the relevant teachings and contents which are incorporated herein by reference, include: U.S. Pat. No. 4,936,590 by Palmer, entitled "Pitch game"; U.S. Pat. No. 6,749,201 by Kessler et al, entitled "Stackable washer tossing game apparatus and method of play"; U.S. Pat. No. 8,162,318 by Peterson et al, entitled "Article tossing game assembly"; 2008/0237990 by Litz, entitled "Washer toss"; 2010/0176554 by Godwin, entitled "Ring toss game"; and Des 489,415 by Grunt, entitled "Disc-toss game".

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a portable bag tossing game. First and second rigid playing surfaces define bag targets. Each of the first and second rigid playing surfaces has a top major surface, an opposed bottom major surface, an aperture extending entirely through from the top major surface to the bottom major surface, a front edge surface extending between the top major surface and the bottom major surface, a back edge surface extending between the top major surface and the bottom major surface and located distal to the front edge surface, and first and second side edge surfaces each extending between the top major surface and the bottom major surface and also extending from the first edge surface to the back edge surface. A first riser is coupled to the first rigid playing surface adjacent to the back edge surface and distal to the front edge surface. The first riser has a first raising configuration elevating the first rigid playing surface back edge relative to the first playing surface front edge surface, and a second leveling configuration leveling the first playing surface back edge relative to the first playing surface front edge surface. A second riser is coupled to the second rigid playing surface adjacent to the back edge surface and distal to the front edge surface. The second riser has a first raising configuration elevating the second playing surface back edge relative to the second playing surface front edge surface, and a second leveling configuration leveling the second playing surface back edge relative to the second playing surface front edge surface. An outer frame is affixed to the first rigid playing surface and has an outer front frame member affixed adjacent to the first playing surface front edge surface, a first outer side frame member affixed adjacent to the first playing surface first side edge surface, and a second outer side frame member affixed adjacent to the first playing surface second side edge surface. The first and second outer side frame members each have a first end adjacent to the outer front frame member and a second end adjacent to the first riser, while defining an outer frame gap between the second end and the first riser. An inner frame is affixed to the second rigid playing surface and has an inner front frame member affixed adjacent to the second playing surface front edge surface, a first inner side frame member affixed adjacent to the second playing surface first side edge surface, and a second inner side frame member affixed adjacent to the second playing surface second side edge surface. The first and second inner side frame members each have a first end adjacent to the inner front frame member and a second end adjacent to the second riser. The first rigid playing surface, first riser, and outer frame have a first deployed configuration with the first riser in the first raising configuration and the outer front frame member resting upon the ground, and a second storage and transport configuration with the first riser in the second leveling configuration. The second rigid playing surface, second riser, and inner frame have a first deployed configuration with the second riser in the first raising configuration and the inner front frame member resting upon the ground, the second rigid playing surface, the second riser, and the inner frame resting upon the ground and spaced apart from the first rigid playing surface, first riser, and outer frame. The second rigid playing surface, second riser, and inner frame have a second storage and transport configuration with the second riser in the second leveling configuration. The inner frame when in the second storage and transport configuration is further nested within the outer frame, with the first inner side wall passing through the gap between the first outer side frame member and the first riser, and the second inner side wall passing through the gap between the second outer side frame member and the first riser.

In a second manifestation, the invention is a leg set configured to elevate one end of a cornhole target. A pair of legs are separated and rigidly coupled by a center-mounted leg support. A pair of leg pintle blocks pivotally support the pair of legs and center-mounted leg support. A rotation stop supports, separates, and rigidly couples the pair of leg pintle blocks.

OBJECTS OF THE INVENTION

Exemplary embodiments of the present invention solve inadequacies of the prior art by providing a pair of corn hole target boards that nest together to consume a volume only very slightly greater than required by a single one of the pair of boards. The nesting is accomplished using "U" shaped frame members on a bottom face of each playing surface, with the inner "U" shaped frame members slipping between the outer "U" shaped frame members and an outer leg set. When arranged in this manner, the front frame members of both corn hole target boards are located next to their respective edges of the playing surface, and the distally located leg sets are offset from the distal edge by an identical amount on each playing surface. This ensures identical slope and front faces, ensuring that the present invention is compliant with industry regulations.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a safe and convenient bag toss game suitable for use by nearly all persons that is simultaneously intuitive and easy to set up from storage to a deployed configuration. A second object of the invention is to provide a pair of cornhole target boards that are compliant with the ACO and ACL standards. As a corollary thereto, an object of the invention is to space the two legs on each cornhole target board by the same amount as the leg spacing on the other cornhole board. As a further corollary thereto, an object of the invention is to locate like front frame members on each board immediately adjacent to the edge of the playing surface, while locating the leg sets inset on each board by a like amount, preferably offset from the back edge of the playing surface by a thickness of the inner and outer frame members. Another object of the present invention is to minimize the dimension of the bag toss game when in a storage and transport configuration. A further object of the invention is to provide nesting and substantial frames that are readily and securely interlocked together through the body of the frame members for storage and transport, and equally readily and intuitively separated for deployment of individual boards. Yet another object of the present invention is to limit the separated and distinct components to only the two boards, meaning there are no components disconnected from the two boards in either the deployed configuration or the storage and transport configuration. A further object of the invention is to reduce the volume of the corn hole boards when nested to only slighter more volume than consumed by a single one of the deployed corn hole boards. An additional object of the invention is to form a parallelepiped when the corn hole boards are nested, thereby providing a compact, positionally stable configuration for storage and transport.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 6 illustrates a preferred embodiment nested corn hole board game, including the second preferred embodiment nesting corn hole target board of FIG. 4 nested within the first preferred embodiment nesting corn hole target board of FIG. 1, from side elevational view.

FIG. 7 illustrates the preferred embodiment nested corn hole board game of FIG. 6 from a bottom sectional view taken along section line 7' of FIG. 6.

DESCRIPTION OF THE PREFERRED EMBODIMENT

Figure 4:
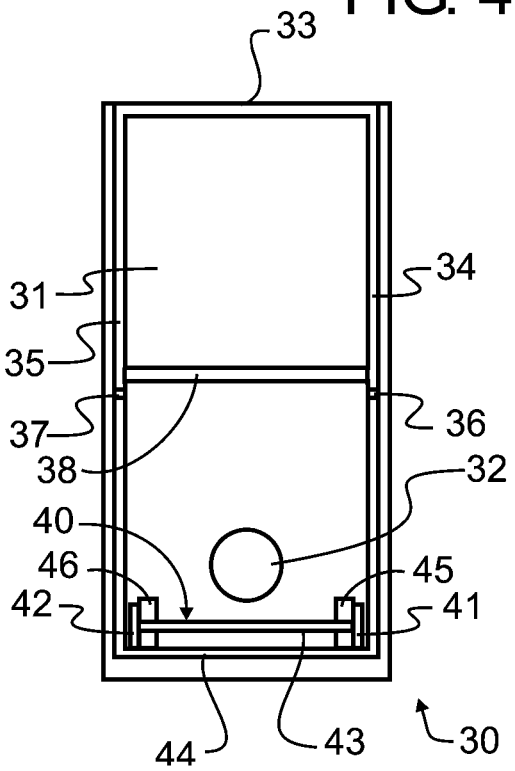
FIG. 4 illustrates a second preferred embodiment nesting corn hole target board designed in accord with the teachings of the present invention from a bottom plan view with the legs extended.
Figure 3:
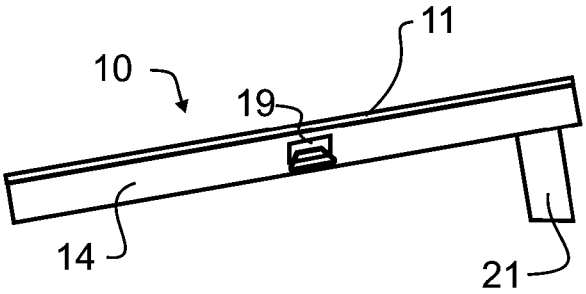
FIG. 3 illustrates the first preferred embodiment nesting corn hole target board of FIG. 1 from a side elevational view with the legs extended.

Manifested in the preferred embodiment, the present invention provides a nested corn hole board game 1 having two configurations. A first storage and transport configuration illustrated in FIG. 6 nests a corn hole target board 30 within a corn hole target board 10 to define a single parallelepiped with no loose parts. A second deployed configuration illustrated for example in FIGS. 3 and 4 provides two separate and distinct corn hole target boards 10, 30 that are spaced apart and ready for use by participants as targets for bag tossing in the ordinary and known manner of use.

Figure 1:
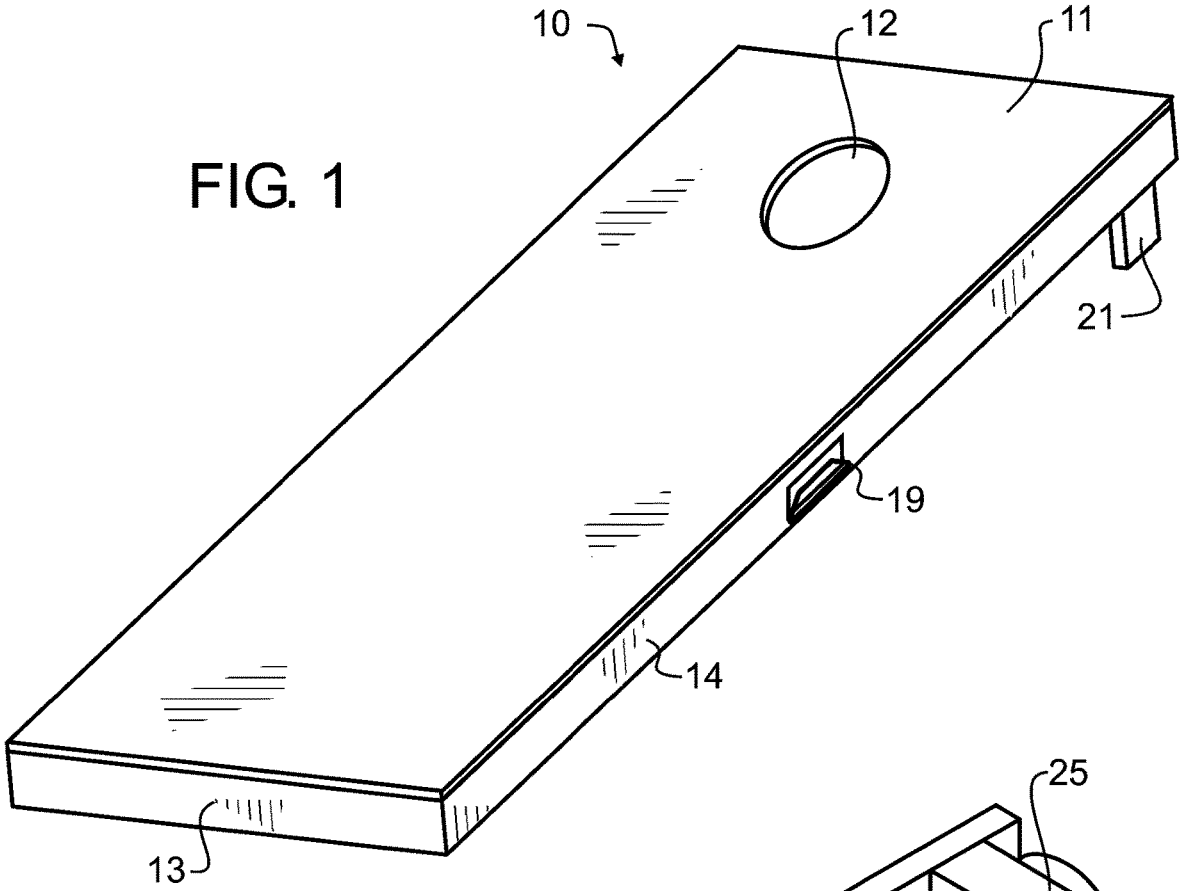
FIG. 1 illustrates a first preferred embodiment nesting corn hole target board designed in accord with the teachings of the present invention from an isometric view.
Figure 2:
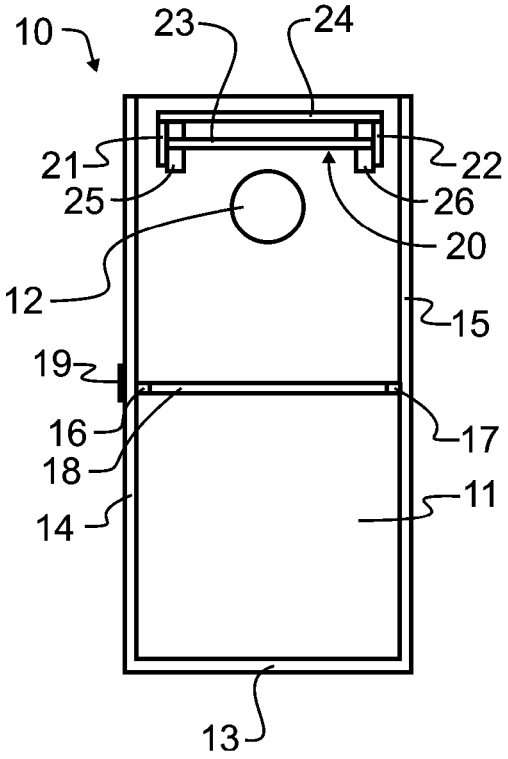
FIG. 2 illustrates the first preferred embodiment nesting corn hole target board of FIG. 1 from a bottom plan view with the legs extended.

Corn hole target board 10 has a playing surface 11 that defines a first major active playing face which is visible in FIG. 1 and which is regularly struck by cornhole bags. A second major bottom face which is visible in FIG. 2 is opposed to the first major active playing face. An aperture or hole 12 passes entirely through playing surface 11 from the first major active playing face to the second major bottom face.

As visible in FIG. 2, preferably rigidly affixed to the second major bottom face of playing surface 11 and immediately adjacent to the minor faces or edges of playing surface 11 are a plurality of interconnected frame members that form a lip circumscribing the second major bottom face of playing surface 11. Outer front frame member 13 is intermediate between outer side frame members 14, 15. As visible in FIG. 2, this plurality of interconnected frame members 13-15 forms a "U" shape, with outer front frame member 13 defining the base of the "U" and outer side frame members 14, 15 defining the vertical legs of the "U". Located between and spaced from the ends of outer side frame members 14, 15 that are distal to outer front frame member 13 is an outer leg set 20 that, similar to the plurality of interconnected frame members 13-15 is rigidly affixed to the second major bottom face of playing surface 11. Optionally, a cross brace 18 may be provided that spans between outer side frame members 14, 15 at some position intermediate between outer front frame member 13 and outer leg set 20.

Figure 8:
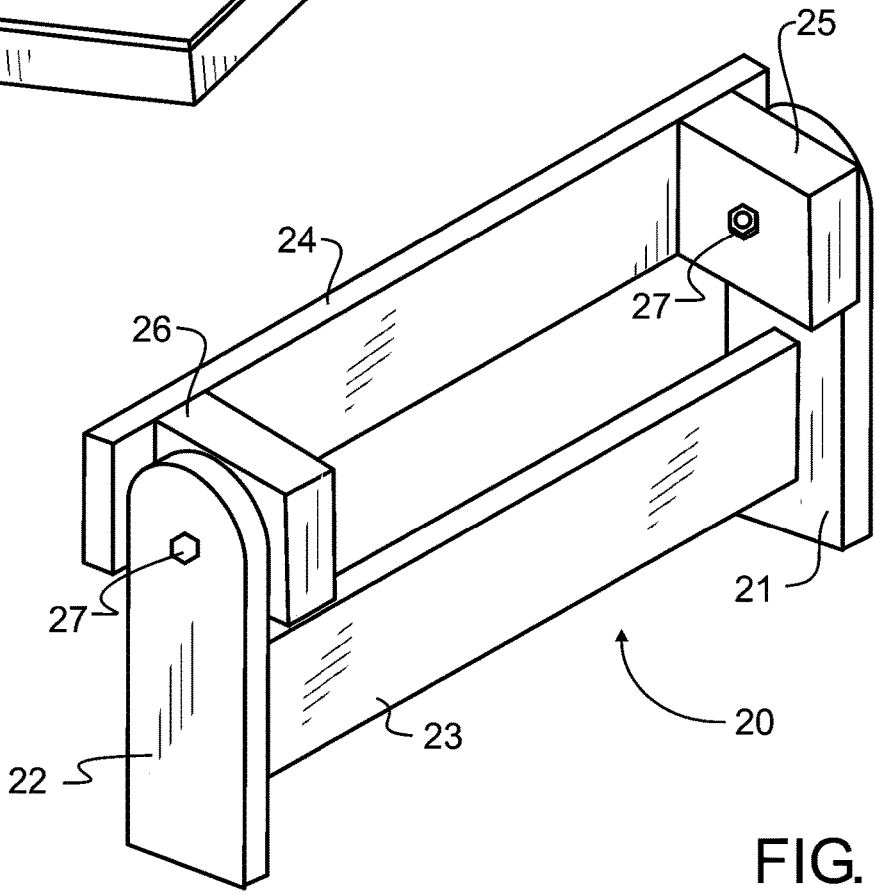
FIG. 8 illustrates a preferred embodiment outer leg set used within the first preferred embodiment nesting corn hole target board of FIG. 1 from an isometric view.

Outer leg set 20 is illustrated in enlarged format in FIG. 8. A pair of opposed legs 21, 22 are rigidly coupled together by a center-mounted leg support 23, with the legs 21, 22 illustrated in a deployed configuration that elevates the adjacent end of corn hole target board 10. While optional, center-mounted leg support 23 ensures that legs 21, 22 rotate in unison, meaning the legs can be deployed or collapsed from a single side of corn hole target board 10. In addition, center-mounted leg support 23 provides an added degree of strength and stability. Legs 21, 22 are pivotally coupled with and thereby are configured to selectively rotate about leg pintle blocks 25, 26. While any suitable pintle may be provided therebetween, as illustrated and in some embodiments a well-known bolt, washer, and nut combination 27 is preferred. The ends of opposed legs 21, 22 adjacent to leg pintle blocks 25, 26 are preferably at least partially rounded or chamfered or beveled. This allows opposed legs 21, 22 to rotate about the bolt, washer, and nut combination 27 with the ends of opposed legs 21, 22 adjacent to leg pintle blocks 25, 26 remaining out of contact with rotation stop 24.

As may be appreciated, when opposed legs 21, 22 are rotated in a clockwise direction as viewed from the perspective of FIG. 3, they will collapse to a storage and transport configuration in contact with or immediately adjacent to the second major bottom face of playing surface 11. Further rotation in this same clockwise direction as viewed from the perspective of FIG. 3 is prevented by the second major bottom face of playing surface 11.

When instead opposed legs 21, 22 are rotated in a counter-clockwise direction as viewed from the perspective of FIG. 3, they will open out into a deployed configuration such as illustrated in FIGS. 3 and 8. Further rotation in this same counter-clockwise direction as viewed from the perspective of FIG. 3 is prevented by rotation stop 24.

In addition, when opposed legs 21, 22 are in the deployed configuration such as illustrated in FIGS. 3 and 8, with a preferred arrangement and suitable quality of construction, a relatively large edge face of opposed legs 21, 22 will preferably contact rotation stop 24, thereby reducing the chance of damage to either opposed legs 21, 22 or rotation stop 24. While not preferred or required for the preferred wood construction of the present invention, in some alternative embodiments additional cushioning is provided at the contact junction between the edges of opposed legs 21, 22 and rotation stop 24. In further alternative embodiments, and again not preferred or required for the preferred wood construction of the present invention, detents or other indexing and locking mechanisms are provided.

While leg sets 20, 40 are preferred, in alternative embodiments other apparatus are provided to raise or elevate the back edge relative to the front frame member, or to otherwise incline playing surfaces 11, 31 when in the deployed configuration. While not limiting the present invention solely thereto, such apparatus includes jacks, blocks, posts, and other suitable apparatus known in the mechanical arts. Most preferably, any leg sets, risers, or other alternative apparatus will have a first deployed position configured to incline the playing surface, and a second contracted, collapsed, compacted or otherwise stowed position that permits corn hole target boards 10, 30 to be nested for the storage and transport configuration.

Corn hole target board 30 has similar, though not identical construction to that of corn hole target board 10. Where not separately discussed, the analogy will be apparent and readily recognized by those reasonably skilled in the art. Playing surface 31 including hole 32 is most preferably identical in all respects to playing surface 11, thereby ensuring consistent performance between corn hole target board 10 corn hole target board 30. Similar to interconnected frame members 13-15 and likewise defining a "U" shape, inner front frame member 33 and inner side frame members 34, 35 are most preferably rigidly interconnected. However, and as best recognized from inspection of FIGS. 4 and 7, inner side frame members 34, 35 are inset slightly from the edge of playing surface 31, by an amount sufficient to accommodate outer side frame members 14, 15. In addition, rotation stop 44 of inner leg set 40 fully spans and may preferably be rigidly interconnected with the ends of inner side frame members 34, 35 distal to inner front frame member 33. The construction order is not critical, and so rotation stop 44 may either be installed into inner side frame members 34, 35, or alternatively may be assembled into a complete leg set similar to that illustrated in FIG. 8, and then subsequently connected to playing surface 31 and inner side frame members 34, 35. In like manner to outer leg set 20, inner leg set 40 is preferably provided with legs 41, 42, center-mounted leg support 43, and leg pintle blocks 45, 46.

As best understood upon inspection of FIG. 7, there are several critical components that are required to match in position and dimension to meet regulations. One of those is the front frame members 13, 33, each which are immediately adjacent to the front edge of playing surfaces 11, 31, respectively. To ensure equal inclination of playing surfaces 11, 31, leg sets 20, 40 must likewise have identical leg length and must be offset from the adjacent edge of playing surfaces 11, 31 by like amount. Both of these requirements have been met in preferred embodiment nested corn hole board game 1 as designed in accord with the teachings of the present invention, without the need for any further components or attachments.

Further, and again as apparent upon inspection of FIG. 7, inner side frame members 34, 35 nest snugly between outer leg set 20 and outer side frame members 14, 15. This relatively snug fit between these large and substantial frame members and leg set enables a person to easily and rapidly convert from the deployed configuration to the storage and transport configuration, without any concern for damaging components. In addition, when in the storage and transport configuration, these large and substantial members will also ensure that preferred embodiment nested corn hole board game 1 remains in this storage and transport configuration in spite of ordinary and reasonable jostling or the like.

Handle 19 is preferably affixed with outer side frame member 14, and may take on any geometry suitable for grasping and transporting. In preferred embodiment nested corn hole board game 1, any suitable additional means may be provided to secure corn hole target boards 10, 30 together when in the storage and transport configuration illustrated in FIG. 6. In the preferred embodiment, a strap with a quick release clasp is wrapped and secured around the two playing surfaces 11, 31 and outer side frame members 14, 15 to secure corn hole target board 30 within corn hole target board 10 when in the storage and transport configuration. Nevertheless, in some alternative embodiments other apparatus such as suitable fasteners are incorporated or provided. In another alternative embodiment, handle 19 is instead affixed with inner side frame member 34 in any suitable manner, and is further configured to pass through a handle aperture formed in outer side frame member 14. With nominal resilience, handle 19 may then act as a simple and intuitive mechanical interlock to further maintain preferred embodiment nested corn hole board game 1 remains in this storage and transport configuration, while also providing a convenient grasping location for carrying.

Figure 5:
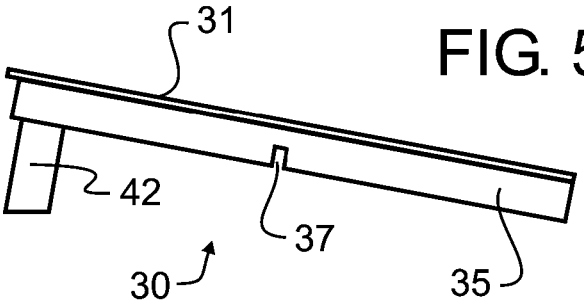
FIG. 5 illustrates the second preferred embodiment nesting corn hole target board of FIG. 4 from a side elevational view with the legs extended.

In those embodiments where at least two cross braces 18, 38 are provided for increased structural support and stability, a pair of cross brace notches 36, 37 visible in FIGS. 4 and 5 are preferably formed into inner side frame members 34, 35 with complementary cut-outs 16, 17 formed into cross brace 18 to allow non-interfering overlap therebetween.

As may be apparent and known from other references incorporated herein above, in the storage and transport configuration the preferred embodiment nested corn hole board game 1 may be used to hold bags and other apparatus that may be required or desired.

As aforementioned, while wood is a preferred primary construction material within preferred embodiment nested corn hole board game 1, it will be appreciated that the present invention is not so limited, and other materials may be used where desired and appropriate.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A portable bag tossing game, comprising:

first and second rigid playing surfaces, each of said first and second rigid playing surfaces having a top major surface, an opposed bottom major surface, an aperture extending entirely through from said top major surface to said bottom major surface, a front edge surface extending between said top major surface and said bottom major surface, a back edge surface extending between said top major surface and said bottom major surface and located distal to said front edge surface, and first and second side edge surfaces each extending between said top major surface and said bottom major surface and also extending from said first edge surface to said back edge surface;

a first riser coupled to said first rigid playing surface adjacent to said back edge surface and distal to said front edge surface, said first riser having a first raising configuration elevating said first rigid playing surface back edge relative to said first playing surface front edge surface, and a second leveling configuration leveling said first playing surface back edge relative to said first playing surface front edge surface;

a second riser coupled to said second rigid playing surface adjacent to said back edge surface and distal to said front edge surface, said second riser having a first raising configuration elevating said second playing surface back edge relative to said second playing surface front edge surface, and a second leveling configuration leveling said second playing surface back edge relative to said second playing surface front edge surface;

an outer frame affixed to said first rigid playing surface having an outer front frame member affixed adjacent to said first playing surface front edge surface, a first outer side frame member affixed adjacent to said first playing surface first side edge surface, and a second outer side frame member affixed adjacent to said first playing surface second side edge surface, said first and second outer side frame members each having a first end adjacent to said outer front frame member and a second end adjacent to said first riser while defining an outer frame gap between said second end and said first riser; and an inner frame affixed to said second rigid playing surface having an inner front frame member affixed adjacent to said second playing surface front edge surface, a first inner side frame member affixed adjacent to said second playing surface first side edge surface, and a second inner side frame member affixed adjacent to said second playing surface second side edge surface, said first and second inner side frame members each having a first end adjacent to said inner front frame member and a second end adjacent to said second riser;

said first rigid playing surface, said first riser, and said outer frame having a first deployed configuration with said first riser in said first raising configuration and said outer front frame member resting upon the ground, and a second storage and transport configuration with said first riser in said second leveling configuration;

said second rigid playing surface, said second riser, and said inner frame having a first deployed configuration with said second riser in said first raising configuration and said inner front frame member resting upon the ground, said second rigid playing surface, said second riser, and said inner frame resting upon the ground and spaced apart from said first rigid playing surface, said first riser, and said outer frame, and a second storage and transport configuration with said second riser in said second leveling configuration;

said inner frame in said second storage and transport configuration further nested within said outer frame, said first inner side frame member passing through said gap between said first outer side frame member and said first riser, and said second inner side frame member passing through said gap between said second outer side frame member and said first riser;

wherein said inner frame and said second riser in combination further comprise a closed rectangular frame; and wherein said outer frame further comprises a "U" shaped geometry having a base comprised of said outer front frame member and having said outer side frame members extending from said base, said first riser located between and spaced from the ends of said outer side frame members that are distal to said base.

2. The portable bag tossing game of claim 1, wherein said inner side frame members, inner front frame member, outer front frame member, and outer side frame members each have a like width and thickness.

3. The portable bag tossing game of claim 2, wherein said first inner side frame member is affixed adjacent to and offset from said second playing surface first side edge surface by said outer side frame members thickness, and said second inner side frame member is affixed adjacent to and offset from said second playing surface second side edge surface by said outer side frame members thickness.

4. The portable bag tossing game of claim 1, wherein said first riser is spaced from said first rigid playing surface back edge surface by a like amount as said second riser is spaced from said second rigid playing surface back edge.

5. The portable bag tossing game of claim 1, wherein said outer frame at least partially circumscribes said inner frame when said first and second rigid playing surfaces are in said second storage and transport configuration.

6. The portable bag tossing game of claim 5, wherein said inner frame nests inside said outer frame.

7. The portable bag tossing game of claim 1, wherein when said first and second rigid playing surfaces are in said second storage and transport configuration said first and second rigid playing surfaces are separated from each other by a width of said inner front frame member.

8. The portable bag tossing game of claim 2, wherein said first and second risers each further comprise a leg set.

9. The portable bag tossing game of claim 8, wherein each said leg set further comprises:

a pair of legs, each one of said pair of legs having a chamfered first end and a second end distal to said first end, said second end configured to contact said ground when in said first deployed configuration, and configured to contact an adjacent one of said first and second rigid playing surfaces when in said second storage and transport configuration;

a center-mounted leg support separating and rigidly coupling said pair of opposed legs together;

a pair of leg pintle blocks pivotally supporting said pair of legs adjacent said first chamfered end and pivotally supporting said center-mounted leg support; and a rotation stop supporting, separating, and rigidly coupling said pair of leg pintle blocks, said rotation stop rising from said adjacent one of said first and second rigid playing surfaces and contacting and thereby stopping rotation of said pair of legs when in said first deployed configuration.

10. The portable bag tossing game of claim 9, wherein said first riser leg set is affixed adjacent to and offset from said first playing surface back edge surface by said width of said inner front frame member, and said second riser leg set is affixed adjacent to and offset from said second playing surface back edge surface by said width of said outer front frame member.

11. The portable bag tossing game of claim 1, wherein each of said first and second playing surfaces top major surfaces are planar.

12. The portable bag tossing game of claim 1, wherein each of said first and second playing surfaces define a parallelepiped.

13. The portable bag tossing game of claim 1, further comprising at least one bag configured to be tossed through at least one of said first and second rigid playing surface apertures when said first rigid playing surface, said first riser, said outer frame, said second rigid playing surface, said second riser, and said inner frame are in said first deployed configuration.

14. The portable bag tossing game of claim 1, further comprising:

a first cross brace extending between and in a direction transverse to said first and second outer side frame members and having a first cut-out and a second cut-out;

a second cross brace extending between and in a direction transverse to said first and second inner side frame members;

a first inner side frame member cut-out; and a second inner side frame member cut-out;

wherein said first and second inner side frame member cut-outs are complementary with said first cross brace first and second cut-outs and are configured to enable non-interfering overlap between said first cross brace and said first and second inner side frame members when said inner frame is in said second storage and transport configuration nested within said outer frame.

* * * * *